US005823759A

United States Patent [19]

Swithenbank

[11] Patent Number: 5,823,759

[45] Date of Patent: Oct. 20, 1998

[54] APPARATUS AND METHOD FOR BURNING COMBUSTIBLE GASES

[75] Inventor: Joshua Swithenbank, Sheffield, England

[73] Assignee: Cabot Corporation, Boston, Mass.

[21] Appl. No.: 525,567

[22] PCT Filed: Mar. 14, 1994

[86] PCT No.: PCT/US94/02715

§ 371 Date: Nov. 7, 1995

§ 102(e) Date: Nov. 7, 1995

[87] PCT Pub. No.: WO94/21967

PCT Pub. Date: Sep. 29, 1994

[30] Foreign Application Priority Data

Mar. 20, 1993 [GB] United Kingdom ..... 9305820

[51] Int. Cl.[6] ..... F23D 13/20

[52] U.S. Cl. ..... 431/5; 431/8; 431/202; 431/115; 431/353

[58] Field of Search ..... 431/5, 8, 9, 350, 431/353, 202, 115, 116

[56] References Cited

U.S. PATENT DOCUMENTS

| | | | |
|---|---|---|---|
| 2,368,370 | 1/1945 | Maxon, Jr. | 431/353 |
| 2,996,143 | 8/1961 | Beasely | 321/202 |
| 3,030,773 | 4/1962 | Johnson | 431/9 |
| 3,460,916 | 8/1969 | Aronsohn | 431/202 |
| 3,828,700 | 8/1974 | Ragot | 110/7 S |
| 3,852,023 | 12/1974 | Itoh et al. | 431/5 |
| 3,864,072 | 2/1975 | Abernathy et al. | 431/5 |
| 3,893,810 | 7/1975 | Lientz | 23/277 C |
| 3,898,317 | 8/1975 | Hemsath et al. | 423/210 |
| 3,954,386 | 5/1976 | Harpenslager et al. | 431/285 |
| 3,985,494 | 10/1976 | Childree | 431/202 |
| 4,003,693 | 1/1977 | Straitz, III | 431/202 |
| 4,067,686 | 1/1978 | Karpisek | 431/353 |
| 4,230,449 | 10/1980 | Binasik et al. | 431/285 |

FOREIGN PATENT DOCUMENTS

| | | | |
|---|---|---|---|
| 1193820 | 6/1970 | United Kingdom | F23D 13/40 |
| 1249967 | 10/1970 | United Kingdom | F23D 13/20 |

*Primary Examiner*—Carl D. Price
*Attorney, Agent, or Firm*—James A. Cairns

[57] ABSTRACT

An apparatus and method for burning the combustible components of a gas stream. The apparatus comprising a a stack pipe having one end in communication with a gas supply pipe for receiving a gas stream and an air supply pipe. Gas and air are introduced into a stack pipe having a mixing zone, stabilization means, an igniter and means to prevent downwash of gaseous products resulting from combustion within the stack pipe.

7 Claims, 2 Drawing Sheets

APPARATUS AND METHOD FOR BURNING COMBUSTIBLE GASES

FIELD OF THE INVENTION

The present invention relates to an apparatus for burning combustible gas and a method for using the apparatus.

BACKGROUND

Gases containing common air pollutants, such as hydrocarbons, alcohols, ethers, soot and other combustibles, are frequently encountered in industries wherein combustion furnaces are utilized. In order to reduce the emission of pollutants and waste smoke into the atmosphere, a variety of devices have been proposed for burning the combustible gases.

A commonly utilized device is referred to as a flare stack wherein combustible gas is burned and discharged into the open air. Several exemplary prior art techniques are disclosed in the following patents.

U.S. Pat. No. 3,828,700 to Ragot discloses an apparatus and process for the smokeless burning of residues. The apparatus consists of a chimney designed for the introduction of air into the burning zone, and a mechanism for introducing the residue into the chimney in the form of a spray. Thus the disclosed apparatus and process require that the residues to be burned off be pulverized or otherwise converted to a spray before introduction into the chimney.

U.S. Pat. No. 3,852,023 to Itoh et al. discloses an apparatus for disposing of gas by burning. The apparatus consists of a plurality of branch pipes connected to a main pipe carrying combustible gas. The gas is channeled into one or more of the branch pipes according to the flow rate in the main pipe. The branch pipes are connected to a combustion furnace having a plurality of stages arranged in vertical order. gas introduced into the combustion furnace through the branch pipes is ignited and burned by ignition means located in the lowermost stage of the furnace.

U.S. Pat. No. 3,898,317 to Hemsath et al. discloses an incineration system for incinerating flue gases which contain a combustible component. The system uses two chambers that are added to a stack emitting industrial gases. The first chamber terminates at the exit end of the stack in an annular passage so that high velocity air, which acts as an air pump, is directed longitudinally relative to the stack. The second chamber is disposed downstream of the first chamber and includes a plurality of burners and a thermocouple that senses the temperature of the gases. A preset temperature is achieved in the chambers by varying the quantities of air emitted from the first chamber as well as the amount of fuel and air supplied to the burners in the second chamber.

U.S. Pat. No. 3,954,386 discloses a flare burner for burning combustible gases. The flare burner consists of a venturi burner tube having specified dimensions, a gas supply pipe having a gas outlet opening at the throat of the venturi burner tube and pilot burner jets for burning combustion gases.

U.S. Pat. No. 4,003,693 discloses a flare stack gas burner consisting of a stack with a centrally disposed combustible gas delivery pipe having a divider with arms for upward delivery of the combustible gas through a plurality of slots to a mixing space. The flare stack also includes a rotary diffuser for mixing the combustible gas with air which is introduced under pressure into the stack.

It is an object of the present invention to provide a method and apparatus for burning the combustible components of gases with the advantages which will become apparent from the following discussion.

SUMMARY OF THE INVENTION

The present invention relates to a method and apparatus for burning the combustible components of gases produced in industrial processes. The method and apparatus are particularly well suited for use in burning the combustible components of the gas stream exiting from a carbon black furnace during the production of carbon blacks.

The apparatus of the present invention comprises:

- a stack pipe having one end in communication with a gas supply pipe for receiving a gas stream;
- means for introducing air into the stack pipe to produce an air and gas mixture;
- a mixing zone;
- means for igniting the air and gas mixture;
- means for stabilizing the ignited mixture; and
- means located at the other end of the stack pipe for inhibiting downwash of the exiting gaseous products resulting from combustion of the gas and air mixture.

The method of the present invention comprises:

- introducing a gas stream containing combustible components into one end of a stack pipe;
- introducing air into the stack pipe to produce an air and gas mixture;
- mixing the air and gas mixture in a mixing zone;
- igniting the air and gas mixture;
- stabilizing the ignited air and gas mixture; and
- allowing the gaseous products resulting from combustion of the gas and air mixture to exit the stack pipe and
- inhibiting downwash of the gaseous products.

The method of the present invention is preferably performed using the apparatus of the present invention.

The gas supply pipe refers to the pipe or conduit emitting gases produced in an industrial process. The gas stream flows from the supply pipe into one end of the stack pipe. In the case of a carbon black furnace reactor, the gas supply pipe emits the gas stream resulting from the production of carbon black. The communication between the gas supply pipe and the end of the stack pipe in the apparatus of the present invention should be sufficient to minimize the possibility of gas escaping into the atmosphere at, or near, the position where the supply pipe and the stack pipe are in communication. As explained below, in a preferred embodiment of the apparatus of the present invention, the gas supply pipe and the stack pipe overlap.

The means for introducing air may be any means known to the art. The amount of air introduced should be sufficient to produce an ignitible mixture of air and gas. Such determination is within the skill of those of ordinary skill in the art. In a preferred embodiment of the apparatus of the present invention, the means for introducing air comprises an annular space formed between the gas supply pipe and the end of the stack pipe, through the use of different diameter pipes.

The introduced air and the gas mix in the mixing zone. The ignitible gas and air mixture is then ignited. The means for igniting the gas and air mixture may comprise any means known to the art for igniting combustible gases, including, but not limited to, pilot burners, spark generators and the like. The means for igniting may be located at any position in the apparatus of the present invention where sufficient mixing of the gas and air mixture has occurred to produce an ignitible mixture. Preferably, the means for igniting is located at a position where the flame, or other igniting means, penetrates the recirculation zone created by the means for stabilizing the ignited gas and air mixture.

In the apparatus and method of the present invention, the ignited gas and air mixture is stabilized to promote substantially complete burning of the combustible components of the gas stream. The means for stabilizing the ignited gas and air mixture comprise means for creating a recirculation zone wherein the ignited gas and air mixture recirculates. As described below in the more detailed description of the invention, the means for stabilizing may comprise a step between a first stack pipe that communicates with the gas supply pipe and a second stack pipe that emits the burned gas and air mixture into the atmosphere. The means for stabilizing may alternatively comprise an object, preferably a cone or hemisphere, located in the interior of the stack pipe that creates recirculation.

After combustion of the combustible components of the gas stream has been achieved, the resultant gaseous products are emitted from the stack pipe into the atmosphere. The emitting end of the stack pipe includes downwash inhibiting means to ensure that the gaseous products resulting from combustion of the gas and air mixture are emitted upwardly into the atmosphere.

The method and apparatus of the present invention advantageously burns the combustible components of a gas stream to minimize the emission of pollutants and smoke into the atmosphere.

Further details and advantages of the apparatus and method of the present invention are set forth in the following more detailed description of the invention.

DETAILED DESCRIPTION OF THE INVENTION

As set forth above, the apparatus of the present invention comprises:

a stack pipe having one end in communication with a gas supply pipe for receiving a gas stream;

means for introducing air into the stack pipe to produce an air and gas mixture;

a mixing zone;

means for igniting the air and gas mixture;

means for stabilizing the ignited mixture; and means located at the other end of the stack pipe for inhibiting downwash of the gaseous products resulting from combustion of the gas and air mixture.

The apparatus of the present invention is particularly advantageous for use on the end of smoke stacks emitting combustible gases from industrial processes.

Figure 1:
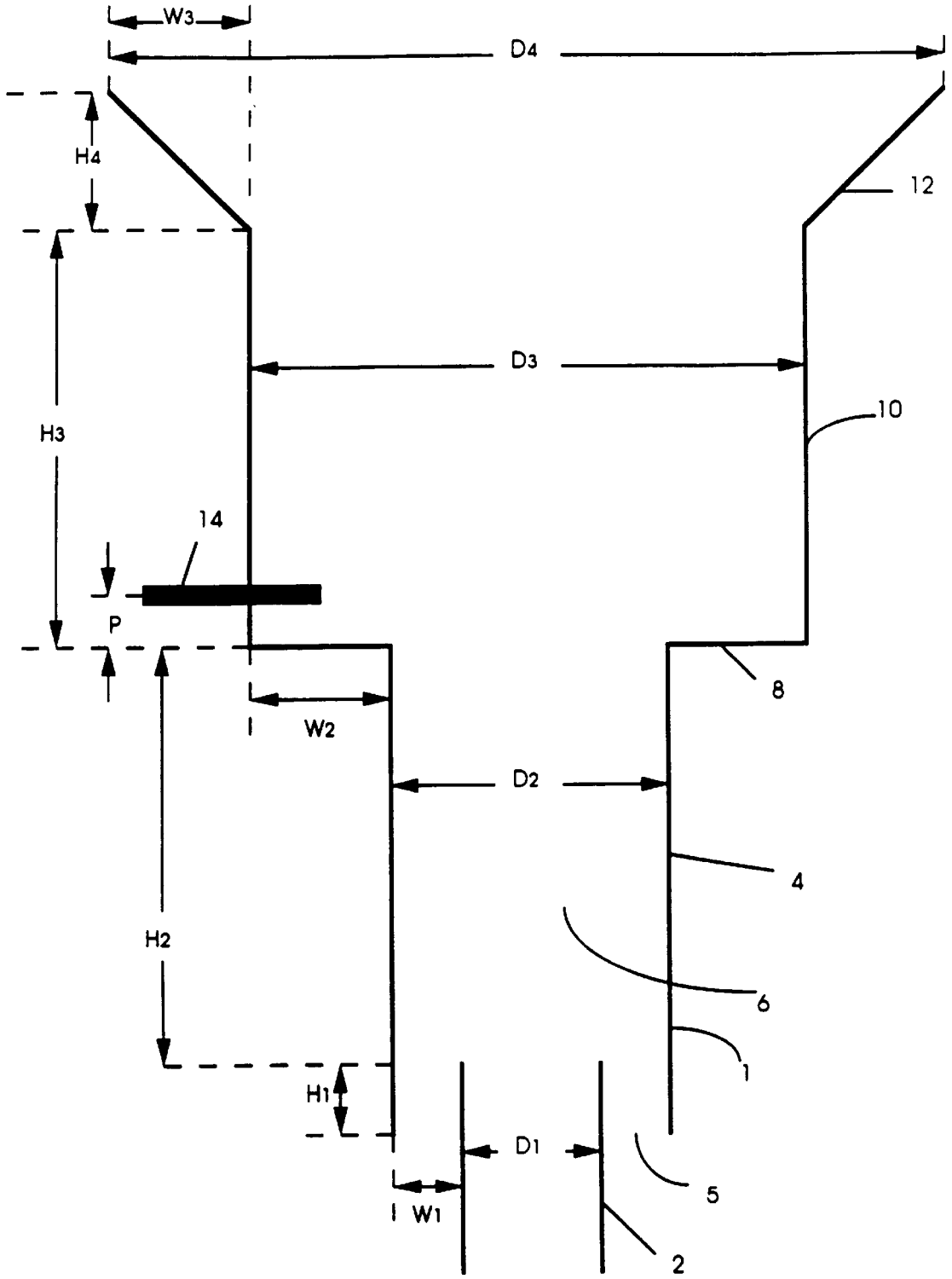
FIG. 1 depicts an embodiment of the apparatus of the present invention.

An embodiment of the apparatus of the present invention is depicted in FIG. 1. As will be readily understood by those of ordinary skill in the art, the apparatus shown in FIG. 1 is designed to be constructed over the end of a smoke stack emitting combustible gases.

With reference to FIG. 1, the apparatus of the present invention, 1, includes a stack pipe, 4, in communication with a gas supply pipe, 2. The inner diameter of the gas supply pipe, 2, is shown as D1 and the inner diameter of the stack pipe, 4, is shown as D2. The arrangement of supply pipe, 2 and stack pipe, 4 should be such that the possibility of gas escaping into the atmosphere is minimized. In a preferred embodiment of the apparatus of the present invention, the pipes overlap as shown in FIG. 1. In FIG. 1, D1 is smaller than D2, and gas supply pipe 2, extends into stack pipe 4, thereby creating means, 5, for introducing air into the stack pipe, 4. The distance that the pipes overlap is shown as H1.

In the embodiment of the apparatus of the present invention shown in FIG. 1, the means for introducing air into the stack pipe, 5, comprises the annular space between the gas supply pipe, 2 and the stack pipe, 4. Air is drawn through the annular space into the stack pipe 4. As set forth above, the amount of air drawn into stack pipe, 4 should be sufficient to produce an ignitible gas and air mixture. Such determination is within the skill of those of ordinary skill in the art. As also set forth above, the means for introducing air into stack pipe, 4, may alternately comprise other means known in the art such as an air supply pipe in communication with stack pipe, 4.

The air mixes with the gases emitted from gas supply pipe, 2, in mixing zone, 6, to form an air and gas mixture. The length of the mixing zone should be sufficient to allow sufficient mixing time for the introduced air and gas to produce an ignitible air gas mixture. In FIG. 1, the length of the mixing zone is shown as H2.

Stack pipe, 4, containing mixing zone, 6, communicates with one end of stack pipe, 10, having inner diameter, D3, and containing means, 14 for igniting the air and gas mixture. Means 14, may comprise any means known to the art for igniting combustible gases, including, but not limited to: pilot burners, spark generators and the like.

The means for igniting, 14 may be located at any position in the apparatus of the present invention where sufficient mixing of the gas and air mixture has occurred to produce an ignitible mixture. Preferably, the means for igniting is located at a position wherein the flame, or other igniting means, penetrates the recirculation zone created by the means for stabilizing the ignited gas and air mixture. In the embodiment depicted in FIG. 1, the means for igniting, 14, are located a distance P from the end of stack pipe, 4, containing mixing zone, 6. The apparatus of the present invention includes at least one means for igniting, and preferably includes more than one means for igniting spaced around the periphery of stack pipe, 10.

Once the gas and air mixture has been ignited, the mixture will generally remain burning. Thus, once ignition occurs, the means for igniting may be turned off. Preferably, however, the means for igniting is not turned off to ensure a constant burning of the air and gas mixture.

In the embodiment of the present invention depicted in FIG. 1, D3 is greater than D2, thereby creating step, 8, having a cross sectional width of W2. The width, W2 should be sufficient to create a stabilization zone for the ignited air and gas mixture. Stabilization is achieved by recirculation of the ignited air and gas mixture.

The length of stack pipe, 10, is shown as H3. Preferably, the length H3 should be sufficient to permit substantially complete combustion of the combustible components of the ignited air and gas mixture.

The other end of stack pipe, 10, communicates with the atmosphere and includes means for inhibiting downwash, 12, to ensure that the gaseous products resulting from combustion of the gas and air mixture are emitted upwardly into the atmosphere. As shown in FIG. 1, the means for inhibiting downwash, 12, may comprise a frustoconically flared portion of stack pipe, 10, which increases the diameter of stack pipe, 10, to diameter D4. The length and width of the flared portion of stack pipe, 10, which comprises the downwash inhibiting means, are shown as H4 and W3 respectively.

The apparatus of the present invention may be constructed from materials known to those of ordinary skill in the art Suitable materials include, but are not limited to: stainless steel, refractory materials and the like.

With reference to FIG. 1, in the method of the present invention, gas emitted from gas supply pipe, 2 mixes with air in mixing zone, 6. The resulting air and gas mixture travels into stack pipe, 10 where the mixture is ignited by ignition means, 14. The resulting ignited mixture is stabilized as a result of step, 8. The combustible components of the air and gas mixture continue to burn in stack pipe, 10 and are discharged into the atmosphere. Downwash inhibiting means, 12, helps to ensure that the combustion products from the ignited gas and air mixture are emitted upwardly into the atmosphere.

Figure 2:
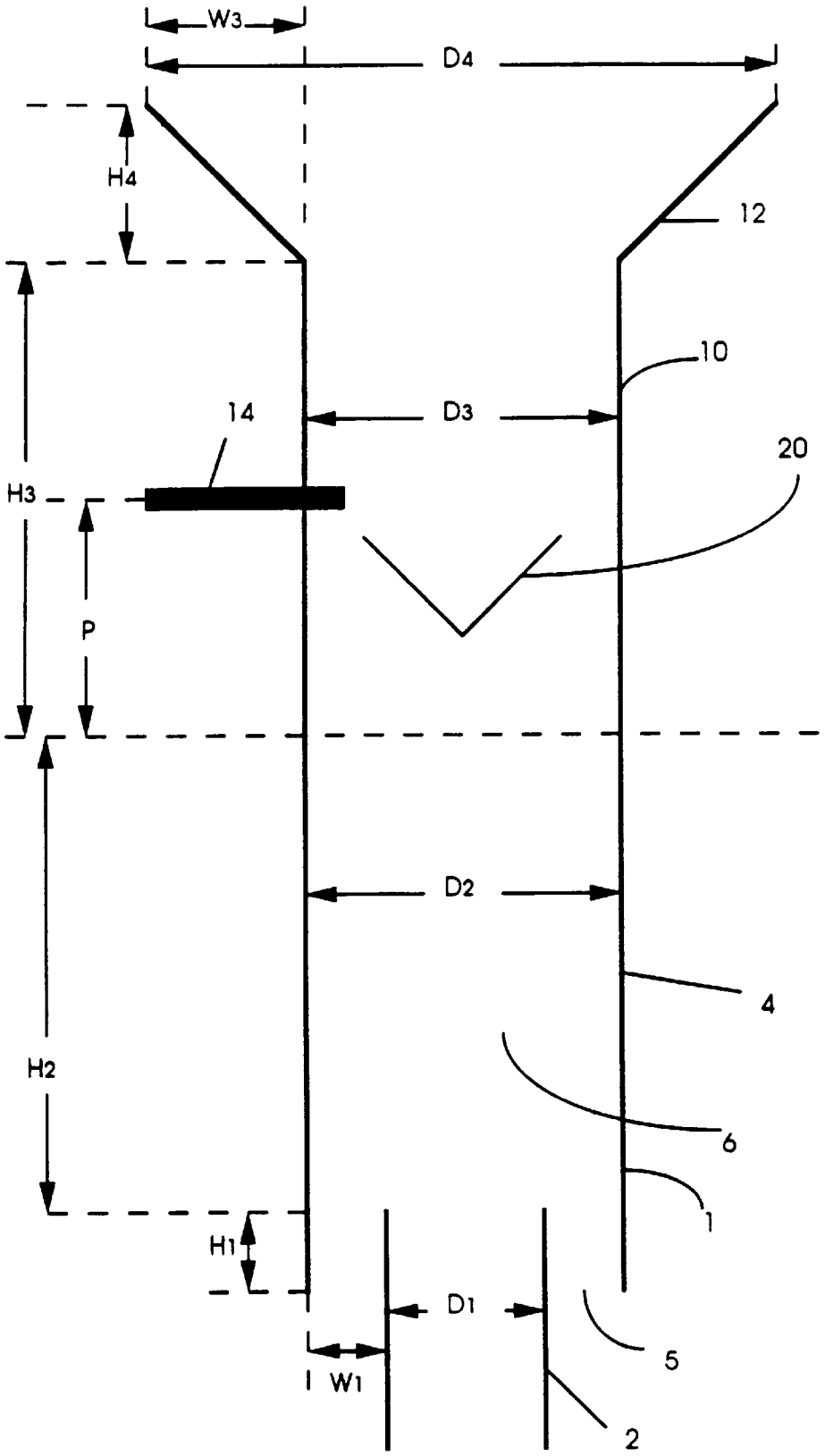
FIG. 2 depicts an alternate embodiment of the apparatus of the present invention.

FIG. 2 depicts an alternate embodiment of the apparatus of the present invention. In the apparatus depicted in FIG. 2, internal flame stabilization means, 20, is provided in stack pipe, 10. The internal flame stabilization means, 20, comprise any object that creates recirculation, preferably a cone or hemisphere and are suspended in the stream flowing through stack pipe 10. The remainder of the apparatus shown in FIG. 2 is similar to the apparatus shown in FIG. 1 except that in the FIG. 2 apparatus, the step, 8, between stack pipes, 4 and 10, has been omitted. The dimensions, including length and internal diameter, of the stack pipes, downwash inhibiting means, and other parts of the apparatus depicted in FIG. 2 may, or may not, be the same as those described with reference to FIG. 1.

In another alternative embodiment of the apparatus of the present invention, the apparatus is constructed with both the internal flame stabilization means, 20, and external flame stabilization means in the form of the step, 8, between stack pipes 4 and 10.

With reference to FIG. 2, in the method of the present invention, gas emitted from gas supply pipe, 2 mixes with air in mixing zone, 6. The resulting air and gas mixture travels into stack pipe, 10 where the mixture is ignited by ignition means, 14. The resulting ignited mixture by stabilizing means 20. The combustible components of the air and gas mixture continue to bum in stack pipe, 10 and are discharged into the atmosphere. Downwash inhibiting means, 12, helps to ensure that the combustion products from the ignited gas and air mixture are emitted upwardly into the atmosphere.

Further details of the apparatus and method of the present invention, and their advantages, will become apparent from the following Example.

A vacuum generator Prima 600 process industrial mass spectrometer, manufactured by VG Gas Analysis System, Ltd. of the United Kingdom was utilized to determine the composition of the gas streams referred to in the following Example. Instructions for utilizing the spectrometer accompany the machine. The gas streams were dried to approximately 2% water, by weight, prior to analysis using Perma Pure dryers, manufactured by Perma Pure Products, Incorporated, of Toms River, N.J.

EXAMPLE

This example illustrates the effectiveness of the method and apparatus of the present invention.

An apparatus of the present invention, as depicted in FIG. 1, was placed in communication with the combustion gas stream emitted from a carbon black furnace reactor during a carbon black production run. The apparatus of the present invention was constructed from stainless steel and utilized a propane burner to ignite the air and gas mixture. The geometry, and operating conditions, utilized are set forth in Table 1.

TABLE 1

| Apparatus Geometry | |
|---|---|
| D-1 (in.) | 3.00 |
| D-2 (in.) | 4.31 |
| D-3 (in.) | 7.50 |
| D-4 (in.) | 12.38 |
| H-1 (in.) | 3.00 |
| H-2 (in.) | 10.50 |
| H-3 (in.) | 7.50 |
| H-4 (in.) | 2.44 |
| W-1 (in.) | 0.66 |
| W-2 (in.) | 1.59 |
| W-3 (in.) | 2.44 |
| P (in.) | 1.50 |
| Propane Flow to Ignitor (scfh) | 2.67 |
| Ignitor Nozzle Size (in.) | 0.50 |
| Feed gas Rate (kscfh) | 9.35 |
| Feed gas Moisture (vol. %) | 35.3 |
| Feed gas Heat Value (BTU/SCF) | 66 |
| Temperature in Supply Pipe, 2 (°F.) | 254 |
| Stream Velocity in Supply Pipe, 2 (ft./s) | 73 |

in. = inches(es); scfh = standard cubic feet per hour; kscfh = thousand standard cubic feet per hour; vol. % = volume percentage; BTU = British thermal unit; °F. = degrees Fahrenheit; ft./s = feet per second The compositions of the gas streams entering and leaving the apparatus of the present invention were determined, after drying, according to the procedures described herein. The results are set forth in Table 2 below:

TABLE 2

| Dried Gas Stream Composition | | |
|---|---|---|
| Compound | Entering Stream | Exiting Stream |
| $N_2$ (vol. %) | 62.50 | 84.18 |
| $O_2$ (vol. %) | 3.56 | 0.00 |
| $CO_2$ (vol. %) | 2.44 | 13.61 |
| Ar (vol. %) | 0.67 | 0.99 |
| $C_2H_2$ (vol. %) | 0.223 | <0.003 |
| $H_2$ (vol. %) | 14.99 | 0.18 |
| CO (vol. %) | 14.55 | 0.82 |
| $CH_4$ (vol. %) | 0.772 | <0.003 |
| $H_2S$ (ppmv) | 626 | <31 |
| $SO_2$ (ppmv) | 631 | 2249 |
| $CS_2$ (ppmv) | 959 | <15 |
| COS (ppmv) | 233 | <15 |

vol. % = volume percentage; ppmv = volume parts per million.

The results provided in Table 2 indicate that the method and apparatus of the present invention reduce the emission levels of all of the combustible components, including $CS_2$, COS, and $H_2S$ in the gas stream. These results also make it apparent that the combustion efficiency of the apparatus of the present invention is high.

These results indicate that the method and apparatus of the present invention are advantageous for use in burning the combustible components of gases.

It should be clearly understood that the forms of the present invention herein described are illustrative only and are not intended to limit the scope of the invention.

I claim:

1. An apparatus for burning the combustible components of a gas stream, said apparatus comprising:

a stack pipe comprising a first end and a second end, said first end being in communication with a gas supply pipe for receiving a gas stream;

means for introducing air into the stack pipe to produce an air and gas mixture;

a mixing zone;

means for igniting the air and gas mixture;

stabilization means for stabilizing the ignited mixture; and means located at said second end of the stack pipe for inhibiting downwash of the gaseous products resulting from combustion of the air and gas mixture.

2. The apparatus of claim 1 further comprising a plurality of stack pipes, wherein a first stack pipe contains said mixing zone; said means for igniting the air and gas mixture are located in a second stack pipe in communication with said first stack pipe and having a diameter larger than the diameter of said first stack pipe, thereby forming a step between said first stack pipe and said second stack pipe; and wherein said flame stabilization means comprise said step between said first and second stack pipes.

3. The apparatus as defined by claim 1, wherein said stabilization means comprise means for creating a recirculation zone for recirculation of the ignited mixture.

4. The apparatus as defined by claim 1, wherein said flame stabilization means comprise an object that creates recirculation suspended in said stack pipe.

5. The apparatus as defined by claim 1, wherein said first end of said stack pipe has a diameter sufficiently larger than the diameter of said gas supply pipe to form an annular space therebetween, said annular space comprising said means for introducing air into said stack pipe.

6. A method for burning the combustible components of a gas stream, said method comprising the steps of:

introducing a gas stream containing combustible components into one end of a stack pipe;

introducing air into the stack pipe to produce an air and gas mixture;

mixing the air and gas mixture in a mixing zone;

igniting the air and gas mixture to produce a flame and gaseous products;

stabilizing the flame produced by igniting the air and gas mixture;

allowing the gaseous products resulting from combustion of the air and gas mixture to exit the stack pipe; and, inhibiting downwash of the gaseous products.

7. The method as defined by claim 6, wherein the step of stabilizing the flame produced by igniting the air and gas mixture comprises suspending an object that creates recirculation in said stack pipe.

* * * * *